United States Patent [19]

Becht

[11] Patent Number: 4,566,621

[45] Date of Patent: Jan. 28, 1986

[54] MEANS FOR ASSOCIATING A DRIVER, CONSTITUTING A PART OF A REPLACEABLE FASTENER CONTAINING MAGAZINE, WITH THE DRIVER OPERATING MECHANISM OF A FASTENER DRIVING TOOL

[75] Inventor: Carl T. Becht, Cincinnati, Ohio

[73] Assignee: Sencorp, Cincinnati, Ohio

[21] Appl. No.: 627,411

[22] Filed: Jul. 3, 1984

[51] Int. Cl.[4] ..... B25F 1/02; B25F 3/00; B25C 5/00

[52] U.S. Cl. ..... 227/109; 227/120

[58] Field of Search ..... 227/6, 7, 109, 120, 227/130, 131, 147; 173/13, 117, 122–124

[56] References Cited

U.S. PATENT DOCUMENTS

| | | | |
|---|---|---|---|
| 3,036,482 | 5/1962 | Kenworthy et al. | 227/147 |
| 3,964,659 | 6/1976 | Eiben et al. | 227/130 X |
| 4,058,047 | 11/1977 | Kramer et al. | 411/478 X |
| 4,298,072 | 11/1981 | Baker et al. | 227/3 X |
| 4,511,074 | 4/1985 | Kille et al. | 227/120 X |

*Primary Examiner*—Paul A. Bell
*Assistant Examiner*—Taylor J. Ross
*Attorney, Agent, or Firm*—Frost & Jacobs

[57] ABSTRACT

Means for associating a driver with the driver operating mechanism of a fastener driving tool, the driver constituting a part of a fastener-containing magazine manually attachable to and detachable from the tool. The fastener driving tool is of the type having a housing containing a driving element constituting a part of an operating mechanism for driving a fastener by multiple blows, or a driving element constituting a part of an operating mechanism for driving a fastener by a single blow. In the instance of a multiple-blow tool, a resilient element, attached to the tool housing adjacent the driver operating mechanism and the driver operating mechanism itself, releasably positions the upper end of the magazine driver adjacent the driving element of the tool. In the instance of a single-blow tool, the magazine driver is releasably positioned adjacent the driving element of the tool by a resilient element attached directly to the driving element of the tool.

13 Claims, 12 Drawing Figures

MEANS FOR ASSOCIATING A DRIVER, CONSTITUTING A PART OF A REPLACEABLE FASTENER CONTAINING MAGAZINE, WITH THE DRIVER OPERATING MECHANISM OF A FASTENER DRIVING TOOL

REFERENCE TO RELATED APPLICATION

This application is related to co-pending application Ser. No. 06/627,396, filed July 3, 1984, in the name of Carl T. Becht, and entitled "A MAGAZINE SYSTEM FOR A FASTENER DRIVING TOOL".

TECHNICAL FIELD

The invention relates to means for associating a driver with the driver operating mechanism of a fastener driving tool, and more particularly to such a driver associating means for a driver which constitutes a part of a fastener-containing magazine manually attachable to and detachable from the fastener driving tool.

BACKGROUND ART

Prior art workers have devised many types of fastener driving tools. As used herein and in the claims, the term "fastener" is to be considered in the broadest sense, referring to substantially any fastener capable of being driven into a workpiece. Examples of such fasteners are headed nails, headless nails, staples and clamp nails (of the general type taught, for example, in U.S. Pat. No. 4,058,047).

Perhaps the most frequently encountered form of fastener driving tool is the pneumatically actuated tool. Pneumatically actuated fastener driving tools have been developed to a high degree of safety and sophistication. The tool taught in U.S. Pat. No. 3,964,659 is exemplary of such a tool.

More recently, there has been considerable interest in electro-mechanical fastener driving tools utilizing a solenoid mechanism or a flywheel mechanism to drive the fasteners. Electro-mechanical fastener driving tools are of particular interest for home use and industrial use where a source of compressed air is not available. An example of such a tool is set forth in U.S. Pat. No. 4,298,072.

The fastener driving tools thus far discussed are of the single-blow variety, wherein the fastener is driven home by a single impact of the tool driver. Prior art workers have also developed various types of multiple-impact fastener driving tools, wherein the fastener is driven home by a plurality of blows applied thereto by the driver. An example of a multiple-impact tool is taught in co-pending application Ser. No. 06/672,428, filed July 3, 1984, in the name of Carl T. Becht, and entitled "MULTIPLE IMPACT FASTENER DRIVING TOOL". The teachings of the present invention are applicable to both basic types of fastener driving tools, and the nature of the fastener driving tool, itself, does not constitute a limitation with respect to the present invention, except as set forth in the claims.

In the above noted co-pending application Ser. No. 06/627,396, filed July 3, 1984 , in the name of Carl T. Becht, and entitled "A MAGAZINE SYSTEM FOR A FASTENER DRIVING TOOL", there is taught a magazine system whereby a single power unit or fastener driving tool (of either the single-blow or multiple-blow type) can readily accept many different magazines, containing different types of fasteners, which can be attached and detached from the fastener driving tool manually and without the aid of tools or any significant mechanical skill. The teachings of this last mentioned co-pending application are incorporated herein by reference.

Briefly, the last mentioned co-pending application teaches a manually attachable and detachable, interchangeable magazine system for use with fastener driving tools. The magazine system is applicable to fastener driving tools of both the single-blow and multiple-blow types. Each magazine contains a plurality of fasteners and captively supports a driver suitably configured for the type of fasteners contained within the magazine.

Each magazine is attachable and detachable by hand to one of the housing of the tool and a carrier within the tool housing. In the instance of a multiple-blow tool, the magazine is shiftable with respect to the tool housing between a normal extended position and a retracted position within the housing. In one embodiment, the magazine is mounted directly on the housing in guided, sliding relationship thereto. In a second embodiment, the magazine is detachably affixed to a carrier mounted within a tool housing in guided, sliding relationship thereto.

In the instance of a single-blow tool, the magazine is fixed with respect to the tool housing. In a third embodiment of the invention, the magazine is detachably affixed directly to the tool housing and is fixed with respect thereto. In a fourth embodiment of the invention, the magazine is detachably affixed to a carrier which, in turn, is fixed with respect to the tool housing, and which may constitute an integral part thereof.

Whether the fastener driving tool is of the single-blow type or the multiple-blow type, the forward end of the magazine is first engaged with the tool body or the carrier, and then the magazine is rotated about that engagement to bring the rearward end of the magazine into engagement with the tool body or the carrier. To disengage the magazine from the tool body or carrier, its rearward end is first disengaged, rotating the rearward end about the front engagement, and then the front portion of the magazine is disengaged from the tool body or carrier.

The magazines can be refillable and reusable magazines, or they can be single-use, disposable magazines. Magazines containing different types of fasteners are fully interchangeable within the system.

The present invention is concerned with the means whereby the drivers, mounted in the various magazines, can be associated with the driving mechanism of the fastener driving tool. As used herein and in the claims, the terms "associating" and "associated" refer to the releasable positioning of a magazine driver adjacent the driving element of the fastener driving tool, so that the driving element of the tool can actuate the magazine driver during a fastener driving operation. As indicated above, when the fastener driving tool is of the multiple-blow type, the magazine driver may be releasably held in position adjacent the tool driving element by resilient means affixed to the tool body. Alternatively, the magazine driver may be releasably attached directly to the tool driving element. Such a direct connection is mandatory when the fastener driving tool is of the single-blow type. Either mode of associating the magazine driver with the tool driving element must be releasable so that the magazine, bearing the driver, can readily be removed from the tool and replaced by another driver-bearing magazine.

DISCLOSURE OF THE INVENTION

According to the invention, there is provided means for associating a driver with the driving element of the driver operating mechanism of a fastener driving tool. The driver comprises a part of a fastener-containing magazine, which is manually attachable and detachable from the tool.

The fastener driving tool may be of the type having a housing containing a driver operating mechanism for causing the driver to drive a fastener by a series of blows. The fastener driving tool can also be of the type having a housing containing a driver operating mechanism causing the driver to drive a fastener by a single blow.

In one embodiment of the invention, wherein the tool is of the multiple-blow type, the magazine driver is maintained adjacent the tool driving element by a resilient wire member. One end of the wire member is captively and non-rotatively mounted in the tool housing, while the other end of the resilient wire member engages a detent on the magazine driver.

In a second embodiment of the present invention, the magazine driver is held adjacent the tool driving element, again by means of a resilient wire member. In this instance, one end of the wire member is affixed to the inside surface of the tool body by an appropriate fastener. The other end of the resilient wire member engages a detent on the magazine driver.

In a third embodiment of the present invention, the magazine driver is maintained adjacent the tool driving element of a multiple-blow tool by a spring biased latch means pivotally mounted in the tool body. The latch means may be provided with an actuating handle portion which extends through the tool body so that the latch means can be manually shifted to its unlatching position prior to engagement of the magazine driver thereby and to release the magazine driver when the magazine is to be removed from the fastener driving tool.

In a fourth embodiment of the present invention, a resilient wire-like member is affixed directly to the tool driving element. The wire-like member has a pair of specially configured legs extending below the tool driving element and capable of releasably engaging notches in the upper end of the magazine driver.

BRIEF DESCRIPTION OF THE DRAWINGS

FIG. 12 is a fragmentary perspective view of the elements of FIG. 11 in assembled condition.

DETAILED DESCRIPTION OF THE INVENTION

Figure 1:
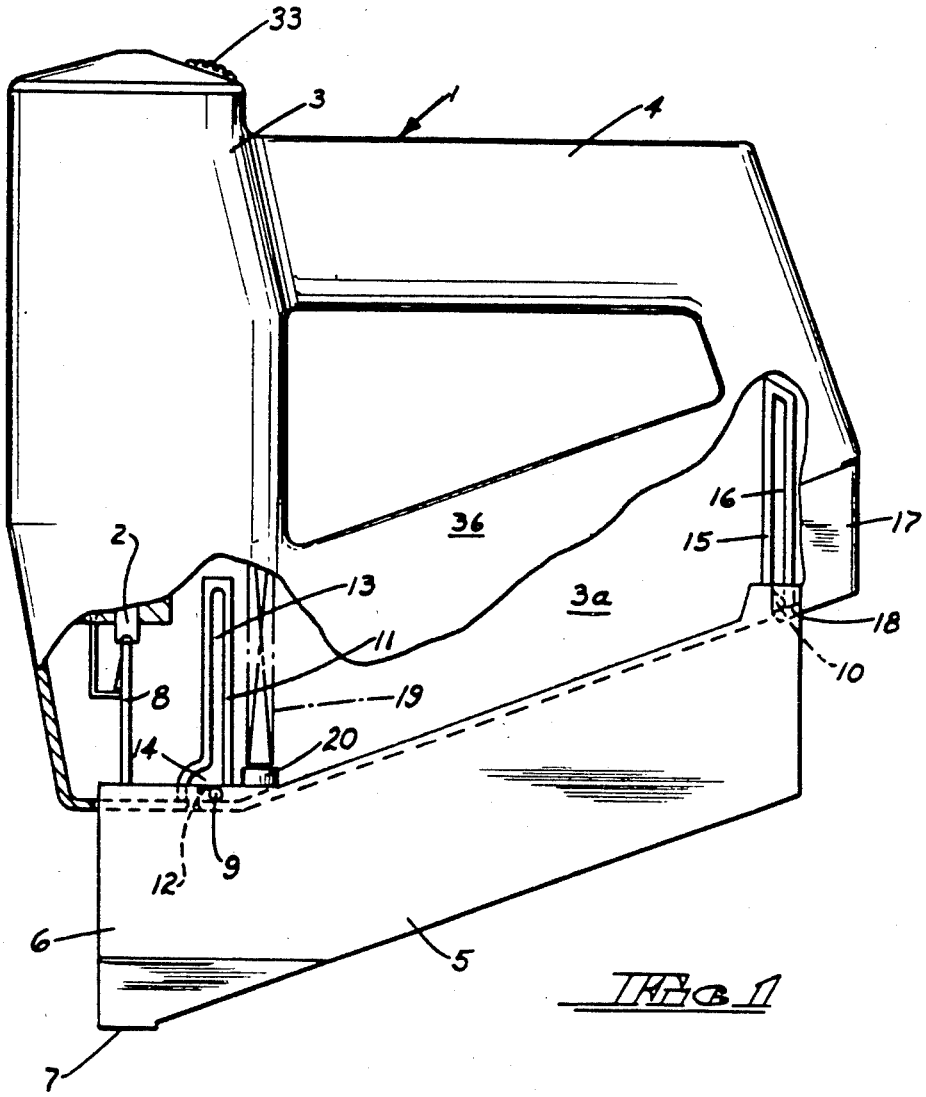
FIG. 1 is a fragmentary, side elevational view, partly in cross-section, and illustrating an exemplary multiple-blow tool and magazine assembly, with one embodiment of a resilient element affixed to the tool body and maintaining the magazine driver in association with the tool driving element.

While not intended to be so limited, as will be apparent hereinafter, the invention will first be described in its application to a multiple-blow fastener driving tool. The precise nature of the tool and its driver operating mechanism does not constitute a part of or a limitation on the present invention. For purposes of an exemplary showing, FIG. 1 illustrates a multiple-blow tool of the general type taught in the above mentioned co-pending application Ser. No. 06/627,428, filed July 3, 1984, in the name of Carl T. Becht, and entitled "MULTIPLE IMPACT FASTENER DRIVING TOOL". The driver operating mechanism is not shown in FIG. 1, since the nature of the driver operating mechanism does not constitute a limitation on the present invention. For example, the tool may be provided with any appropriate type of prime mover, such as an electric motor, an internal combustion motor, a hydraulic motor, a pneumatic motor, or the like. The energy transfer member or tool driving element which cooperates with the magazine driver to impart multiple blows to the fasteners being driven is shown at 2.

The tool 1 has a housing 3 made up of two abutting halves 3*a* and 3*b*. The housing also has a handle portion 4.

In the particular exemplary embodiment illustrated, a magazine 5 is shiftably mounted directly to the housing 3. The magazine 5 comprises an elongated hollow member containing a plurality of fasteners (not shown). The forward portion 6 of magazine 5 terminates at its bottom in a substantially planar surface 7 comprising a nose adapted to contact and abut the workpiece into which fasteners are to be driven. The nose portion 7 has a perforation therethrough (not shown) through which the fasteners are driven. The upper surface of magazine front portion 6 has an opening or slot (not shown) formed therein, through which the magazine driver 8 extends. The driver 8 constitutes a part of the magazine 5, is captively mounted therein, and is capable of shifting in both directions parallel to its long axis. The nature of the driver 8 will depend, of course, on the type of fasteners contained within magazine 5, which it is intended to drive.

The magazine 5 will be provided with suitable means (not shown), as is well known in the art, to urge and advance the supply of fasteners toward the forward end 6 of the magazine, so that when the driver 8 is in its extended position (i.e., with the majority of its length extending outside magazine 5 as shown in FIG. 1), the forwardmost fastener will be located thereunder, in position to be driven thereby. The forwardmost portion 6 of magazine 5, including the nose 7 and that portion in which the driver is reciprocally mounted, is equivalent to and serves the same purpose as the conventional guide body of a typical prior art fastener driving tool, guiding the fastener and the driver during a fastener driving operation. It will be understood that the type of fastener contained within magazine 5, the nature of the means constantly urging the supply of fasteners forwardly within the magazine, and the particular configuration of the driver 8 do not constitute parts of the present invention.

Near its forward end, the magazine 5 has a pair of laterally extending, integral pins which are coaxial and which extend from either side of the magazine 5. One such pin is shown at 9. In similar fashion, a pair of integral lugs are located directly opposite each other and extending to either side of the magazine, near its rearward end. One of these lugs is shown at 10. The body half 3*a*, near its forward end, has integral flanges 11 and 12 formed on its inside surface. These flanges define a guide channel 13 and a short lateral channel 14 which extends from the lower end of the guide channel to the bottom edge of housing half 3*a*. Near the rear of body half 3*a*, another integral flange 15 defines a guide channel 16. It will be understood that body half 3*b* will have flanges identical to flanges 11, 12 and 15, defining channels equivalent to guide channel 13, lateral channel 14 and guide channel 16.

To mount magazine 5 in the body 3 of tool 1, the magazine pin (not shown) equivalent to pin 9 is inserted in lateral channel 14 in body half 3*a*. At the same time, the pin 9 will enter the lateral channel (not shown) in housing half 3*b* equivalent to lateral channel 14. The magazine is shifted upwardly, rearwardly and then downwardly, causing the magazine pin equivalent to pin 9 to enter guide channel 13 and pin 9 to enter the equivalent guide channel in housing half 3*b*. At this point, the magazine 5 is pivoted about pin 9 and its equivalent pin on the opposite side of magazine 5 toward tool 1, to cause the lug (not shown) equivalent to lug 10 to enter guide channel 16 in housing half 3*a* and lug 10 to enter the guide channel in housing 3*b* equivalent to guide channel 16. A spring loaded latch member 17, mounted on tool housing 3, has a pair of forwardly extending lugs, one of which is shown at 18. When in its latching position, these lugs effectively close the bottom end of guide channel 16 in housing half 3*a* and the equivalent guide channel in housing half 3*b*, effectively locking lug 10 and the equivalent lug on the opposite side of magazine 5 in their respective guide channels.

As a result of this mounting, magazine 5 is shiftable within tool housing 3 in a guided fashion through the cooperation of the magazine pins and lugs and the corresponding guide channels formed on the inside surfaces of housing halves 3*a* and 3*b*. The magazine 5 is shiftable between a normal extended position illustrated in FIG. 1 and a fully retracted position within housing 3, determined by the abutment of the magazine pins and lugs with the upper ends (as viewed in FIG. 1) of their respective guide channels in the housing halves 3*a* and 3*b*. The fully retracted position of magazine 5 within housing 3 could alternatively be determined by abutment of the magazine, itself, against one or more appropriate stop surfaces provided within housing 3. This shifting of magazine 5 accommodates for the fact that during the driving process, the length of magazine driver 8 remains constant, but the length of that portion of the fastener above the workpiece (into which it is being driven) diminishes as the fastener is driven. The magazine 5 is biased to its normal, extended position (as shown in FIG. 1) by a compression spring 19. The upper end of the compression spring 19 is appropriately anchored within the housing 3. The lower end of compression spring 19 is mounted on a guided spring anchor 20 which abuts magazine 5, enabling spring 19 to constantly urge magazine 5 to its normal, extended position.

When it is desired to replace magazine 5 with another magazine containing a different type of fastener, or when magazine 5 is of the disposable type and requires replacement, the procedure for disengaging magazine 5 from tool housing 3 is a simple one. It is only necessary to pull rearwardly on latch 17, allowing the latch lugs (one of which is shown at 18) to open the bottom ends of rear housing guide channels (one of which is shown at 16). This enables the rearward magazine lugs (one of which is shown at 10) to be removed from their respective guide channels by simply pulling downwardly on the rearward end of magazine 5, causing it to pivot about the forward magazine pins (one of which is shown at 9). When the rearward end of magazine 5 has been released from housing 3, the forward end of the magazine can be shifted upwardly, forwardly and downwardly to cause the forward pin (not shown) of the magazine to pass out of guide channel 13 and through lateral channel 14, the pin 9 passing out of its respective guide channel and through its respective lateral channel (not shown). The magazine 5 is then fully detached from housing 3 and can be replaced. If the magazine 5 is of the refillable type, it can be refilled without detaching it from tool housing 3.

Figure 2:
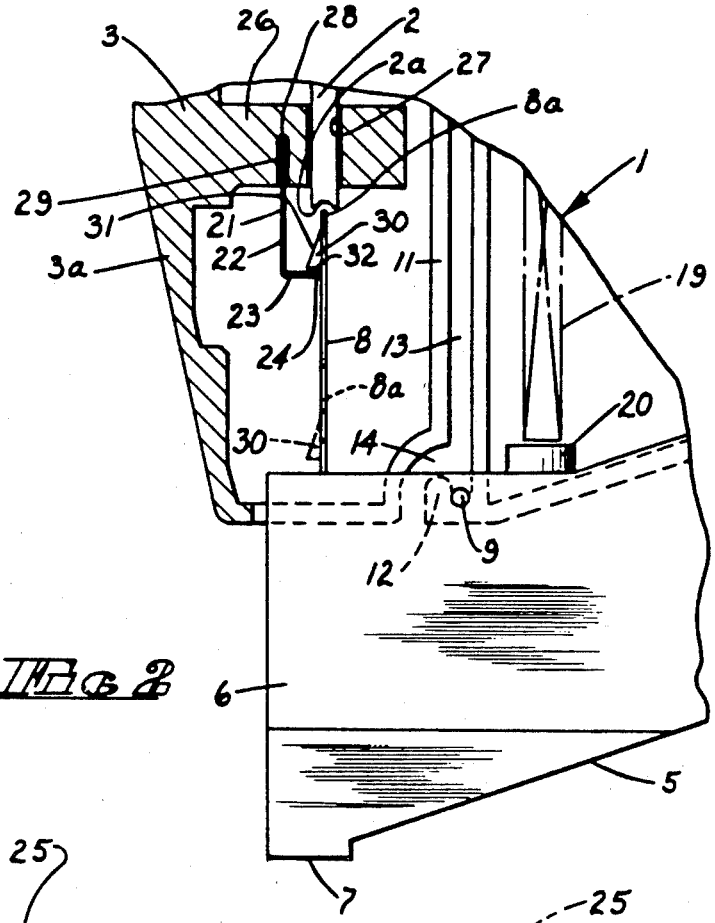
FIG. 2 is an enlarged fragmentary view, partly in cross-section, illustrating the resilient magazine driver supporting element of FIG. 1.
Figure 3:
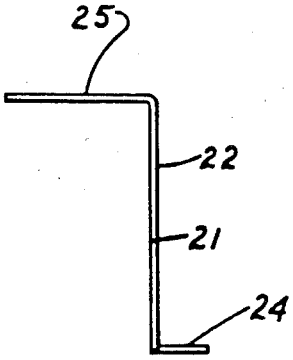
FIGS. 3 and 4 are, respectively, front and side elevational views of the resilient driver supporting element of FIGS. 1 and 2.
Figure 4:
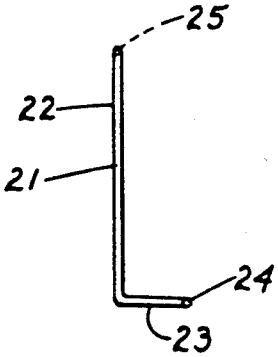

Once magazine 5 has been appropriately mounted in housing 3 of tool 1, in order for the tool to be operative, it is necessary to interface magazine driver 8 with the tool driving element 2. This can be accomplished in a multiple-blow tool by holding the magazine driver 8 adjacent the tool driving element 2 by means of a resilient member 21 affixed to tool housing 3. In side elevation, the resilient member 21 is L-shaped, as is shown in FIGS. 2 and 4. Resilient member 21 has a long leg 22 and a short leg 23 angled at 90° with respect to each other. As is most clearly shown in FIG. 3, the free end of short leg 23 terminates in a laterally extending portion 24, while the free end of long leg 22 terminates in a laterally extending portion 25. The lateral portions 24 and 25 extend in opposite directions.

The resilient member 21 may be mounted within the tool body 3 in any appropriate manner. For purposes of an exemplary showing, the body half 3*a* is illustrated as having an integral web 26 formed on its inside surface. It will be understood that the housing half 3*b* will have a corresponding web and that these webs will be in abutment when housing halves 3*a* and 3*b* are assembled together. The web 26 has a notch or groove 27 formed therein. The web (not shown) of housing half 3*b* will have a similar notch or groove. When the housing halves 3*a* and 3*b* are joined together, the groove 27 of web 26 and the corresponding groove of the web in housing half 3*b* form a guiding passage for the tool driving element 2, which is slidably mounted therein. The web 26 has a transverse bore 28. A groove 29 is formed in web 26 and extends from its bottom edge to the bore 28. Resilient member 21 is mounted on web 26 with its upper transverse portion 25 extending into bore 28 and the upper portion of its long leg 21 lying in groove 29. When housing halves 3*a* and 3*b* are joined together, the corresponding web on housing half 3*b* abuts the web 26 and thereby encloses the groove 29 and bore 28, trapping resilient member 21 therein. It will be apparent from this arrangement that the resilient element 21 is captively held in place and rotation thereof about the axis of transverse portion 25 or the axis of long leg 22 is precluded.

Near its free or upper end, the magazine driver 8 is provided with a detent 30. The detent has a forward surface 31 sloping downwardly and forwardly, and a lower surface 32 which is substantially perpendicular to the magazine driver 8.

It will be apparent from FIG. 2 that the transverse portion 24 of resilient member 21 underlies and supports bottom surface 32 of driver detent 30. The resilient member 21 is so sized that this engagement will support the magazine driver 8 with its free or upper end 8*a* adjacent the lower end 2*a* of tool driving element 2. As will be apparent hereinafter, it is preferred that when the magazine driver 8 is supported by resilient member 21, its upper end 8*a* be spaced slightly from the lower end 2*a* of tool driving element 2, as shown in FIG. 2. As a result, the term "adjacent", as used herein and in the claims, should be interpreted to take into account such slight spacing. The bottom end 2*a* of tool driving element 2 may have a shallow notch formed therein, as shown in FIG. 2, to accommodate for any vibration or wobble in magazine driver 8 during the fastener driving operation.

When the magazine 5 is first used and is attached to the tool housing 3, its driver 8 will normally occupy a retracted position, the majority of its length being located within magazine 5. This is illustrated in FIG. 2 wherein the detent 30 and the upper or free end 8*a* of magazine driver 8 are shown in broken lines. In order to achieve the interfacing of the magazine driver 8 and the tool driving element 2, the operator places the nose 7 of the magazine against a surface or workpiece and shoves downwardly on the tool. This will cause the magazine 5 to shift upwardly within the housing 3 against the action of compression spring 19. As the magazine 5 moves upwardly within the tool housing 3, the downwardly and forwardly sloped surface 31 of magazine driver detent 30 will contact the transverse portion 24 of resilient member 21, shoving it forwardly. This will continue until the magazine 5 is fully seated within the tool housing 3, at which point the transverse portion 24 of resilient member 21 will snap beneath and engage the lower surface 32 of driver detent 30, thereby holding the magazine driver upper end 8*a* adjacent the lower end 2*a* of tool driving element 2. The operator then lifts the tool 1 away from the surface or workpiece permitting magazine 5 to return to its normal extended position shown in FIGS. 1 and 2, under the influence of compression spring 19. The engagement of the magazine driver detent 30 by resilient member 21 will cause the magazine driver 8 to be pulled upwardly to its extended position as shown in solid lines in FIG. 2. Since the majority of the length of the magazine driver is now outside of magazine 5, the means within the magazine 5 to urge the fasteners forwardly therein will locate the forwardmost one of the fasteners beneath the magazine driver 8 and the tool 1 is now ready for use.

The tool 1 is connected to an appropriate power source and its power switch 33 (see FIG. 1) is activated. The nose 7 of magazine 5 is located on a workpiece at the position where it is desired to drive a fastener. Pressure is applied on the tool toward the workpiece. The initial downward pressure will cause magazine driver 8 to come in contact with the foremost fastener in the magazine. Continued downward pressure will cause the tool driving element 2 to be actuated, resulting in reciprocation of the tool driving element 2 and the magazine driver 8. Reciprocation of these elements will continue as long as pressure is applied to the tool 1 in a direction toward the workpiece, or until the fastener is fully driven.

Once the fastener has been driven, the tool 1 is raised from the workpiece, thereby permitting magazine 5 to return to its normal extended position and, at the same time, returning the magazine driver 8 to its normal extended position, permitting another fastener to be located beneath the magazine driver 8, ready to be driven. The fastener driving process can be repeated as often as desired, or until the supply of fasteners within magazine 5 is spent. The magazine 5 can then be refilled or removed from tool housing 3 and replaced by a different magazine.

It should be remembered from the description above, that during the removal procedure for magazine 5, its rearward end is first released from latch 17. When the rearward end is so released, the magazine will pivot slightly about its forward pins (one of which is shown at 9). This pivoting of magazine 5 will cause the magazine driver 8 to disengage itself from the tool driving element 2 and the transverse portion 24 of resilient member 21. Removal of the forward magazine pins (one of which is shown at 9) from their respective guide channels (one of which is shown at 13) will permit complete removal of magazine 5 from tool housing 1.

It may be desirable to remove the magazine 5 from tool 1 before its supply of fasteners is depleted. For example, it may be desired to utilize a different type of fastener for another specific job. Under these circumstances, when the magazine 5 is removed, its driver 8 will remain in its up or extended position since there will be a fastener thereunder. When it is desired to reattach magazine 5 to tool 1, the fact that the magazine driver 8 is in its extended position does not present a problem. It should be remembered from the description above, that during the magazine attachment procedure, the magazine 5 is first attached at its forward end by means of its lateral pins, one of which is shown at 9. The magazine 5 is then rotated toward tool 1 to cause its rearward lugs, one of which is shown at 10, to be engaged with the tool body channels, one of which is shown at 16. This slight rotation of the magazine will cause the driver 8 to pivot along with the magazine. Since there is slight clearance between the uppermost end 8*a* of driver 8 and the lower end 2*a* of tool driving element 2, the upper end of driver 8 is free to swing into the position shown in FIG. 2, with its detent 30 located just above the transverse portion 24 of resilient member 21. The magazine 5 is then ready for use with tool 1.

As noted above, the previously mentioned co-pending application Ser. No. 06/627,396, filed July 3, 1984, in the name of Carl T. Becht, and entitled "A MAGAZINE SYSTEM FOR A FASTENER DRIVING TOOL", embodiments are taught wherein a carrier is shiftably and captively mounted within the tool body and magazines are attachable to and detachable from the carrier. As is taught in the last mentioned co-pending application, the carrier is provided near its forward end and near its rearward end with laterally extending pins or lugs which are received and captively maintained in channels in the tool body halves similar to channels 13 and 16 of FIG. 1. The forward end of the carrier is provided with a pair of hook-like members which engage laterally extending pins at the forward end of the magazine. The rearward end of the magazine has an upstanding hook-like element which, when the magazine is pivoted about its forward laterally extending pins or lugs, engages a resilient latch or tine on the carrier with a snap fit. To disengage the magazine from the carrier, the rearward end of the magazine is first pulled downwardly to disengage the above described hook-like member. This results in slight rotation of the magazine about its forward lateral extending pins or lugs which are then disengaged from the hook-like members of the carrier. Therefore, a resilient member identical to member 21 of FIGS. 2, 3 and 4 can be provided in the tool body, to cooperate with the magazine driver in precisely the same way described above, even when the magazine is attached to a carrier, rather than directly to the tool body.

Figure 5:
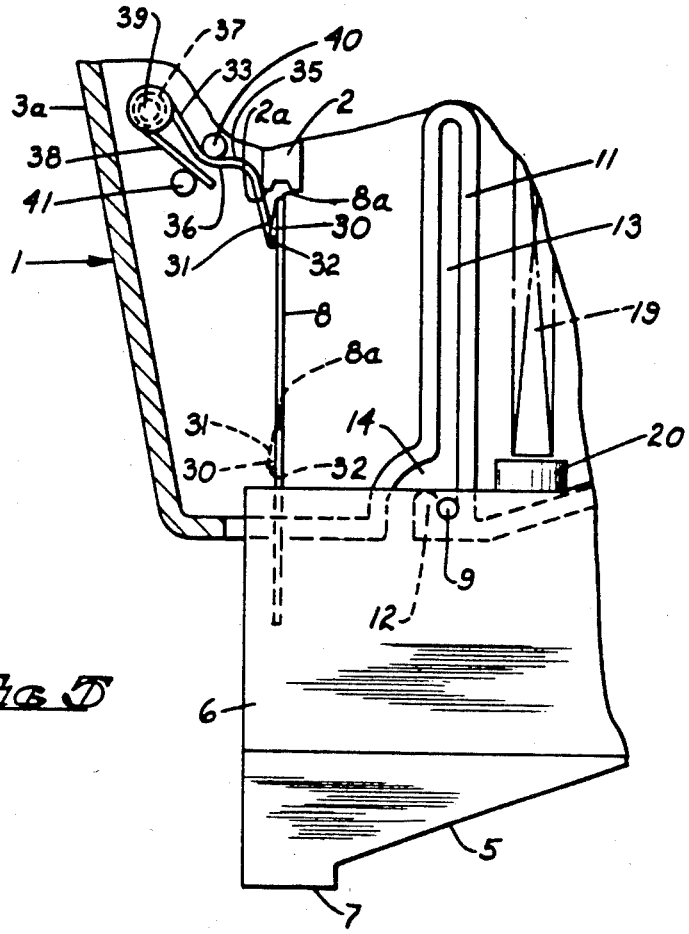
FIG. 5 is an enlarged fragmentary view, partly in cross-section and similar to FIG. 2, illustrating a second embodiment of the resilient magazine driver supporting element.
Figure 6:
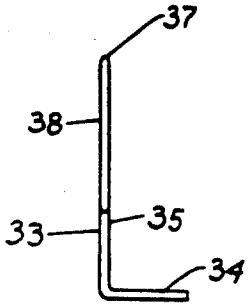
FIGS. 6 and 7 are, respectively, front and side elevational views of the resilient magazine driver supporting porting element of FIG. 5.
Figure 7:
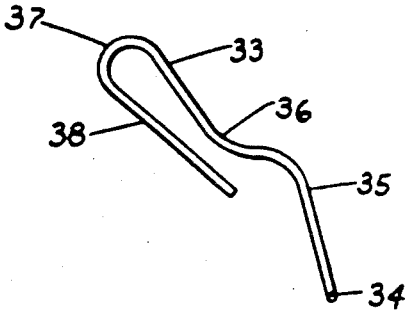

Reference is now made to FIGS. 5, 6 and 7, wherein another embodiment of resilient member is shown. In FIG. 5, the tool and the magazine are substantially identical to tool 1 and magazine 5 of FIGS. 1 and 2, and like parts have been given like index numerals. The tool 1 of FIG. 5 differs from the tool 1 of FIG. 2 only in that the tool body half 3*a* does not have a web like web 26 of FIG. 2, and the same is true of tool body half 3*b* (not shown).

In the embodiment of FIGS. 5, 6 and 7, a resilient wire-like member 33 is provided. As is most clearly seen in FIG. 6, a front elevational view of resilient member 33 reveals its generally L-shaped configuration, having a short leg 34 and a long leg 35 oriented at substantially 90° thereto. As is most clearly seen in FIG. 7, the long leg 35 has a crooked portion 36, a looped portion 37 and a return portion 38.

As shown in FIG. 5, the resilient member 33 is affixed directly to body half 3*a*. To this end, the looped portion 37 is engaged by an appropriate fastening means 39. The fastening means 39 may take any suitable form, such as a bolt, a rivet or the like. The crooked portion 36 of leg 35 abuts a boss 40 formed on the inside surface of body half 3*a*. In similar fashion, the return portion 38 of leg 35 abuts a second boss 41 formed on the inside surface of body half 3*a*. Bosses 40 and 41 are spaced from each other by a distance such that the crooked portion 36 and the return portion 38 of leg 35 are placed in slight compression. The bosses 40 and 41 also assure that the resilient member 33 retains its proper position, and cannot rotate about fastening means 39.

It will be noted that with respect to the cartridge driver detent 30, the short leg 34 of resilient member 33 occupies substantially the same position as the lateral portion 24 of resilient member 21. As a result, the short leg 34 of resilient member 33 cooperates with driver 8 and its detent 30 in exactly the same manner described with respect to the embodiment of FIGS. 2–4. Thus, if magazine 5 is affixed to body 1 with its driver 8 in its retracted position as shown in broken lines in FIG. 5, and if the tool 1 and magazine 5 are pressed against a workpiece, the magazine 5 will shift into the body of tool 1. As this happens, the sloped surface 31 of driver detent 30 will shove the short leg 34 of resilient member 33 forwardly until it snaps beneath driver detent surface 32. When the tool 1 is lifted from the workpiece, the magazine 5 will return to its normal extended position by virtue of compression spring 19, and the resilient member 33 will draw the magazine driver 8 from its retracted position to its extended position shown in FIG. 5, with its upper end 8*a* adjacent the lower end 2*a* of tool driving element 2.

The slight pivoting of magazine 5 about its forward lateral pins (one of which is shown at 9), during the magazine removal operation, will cause the magazine driver and its detent 30 to shift slightly to the right as viewed in FIG. 5, so as to become disengaged from the short leg 34 of resilient member 33. In the embodiment of FIGS. 5–7, the magazine 5 can be replaced on tool 1 with its driver 8 in its extended position, in the same manner as described with respect to the embodiment of FIGS. 2–4. Furthermore, the resilient member 33 can be used when the magazine 5 is carrier mounted, again in the same manner as described with respect to the embodiment of FIGS. 2–4.

Figure 8:
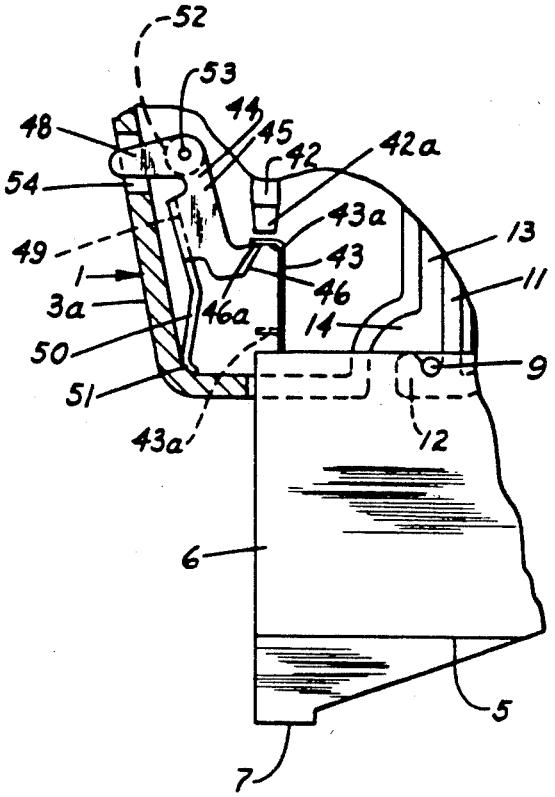
FIG. 8 is an enlarged fragmentary view, similar to FIGS. 2 and 5, and illustrating a resilient latch means for associating the cartridge driver with the tool driving element.
Figure 9:
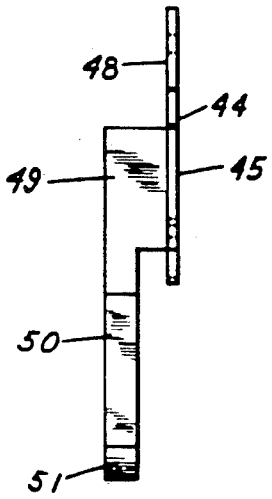
FIGS. 9 and 10 are, respectively, front and side elevational views of the latch means of FIG. 8.
Figure 10:
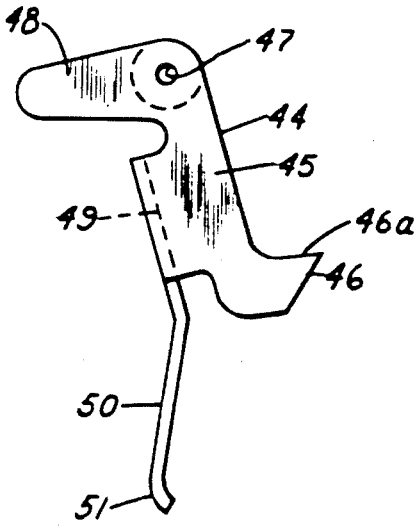
Figure 10:
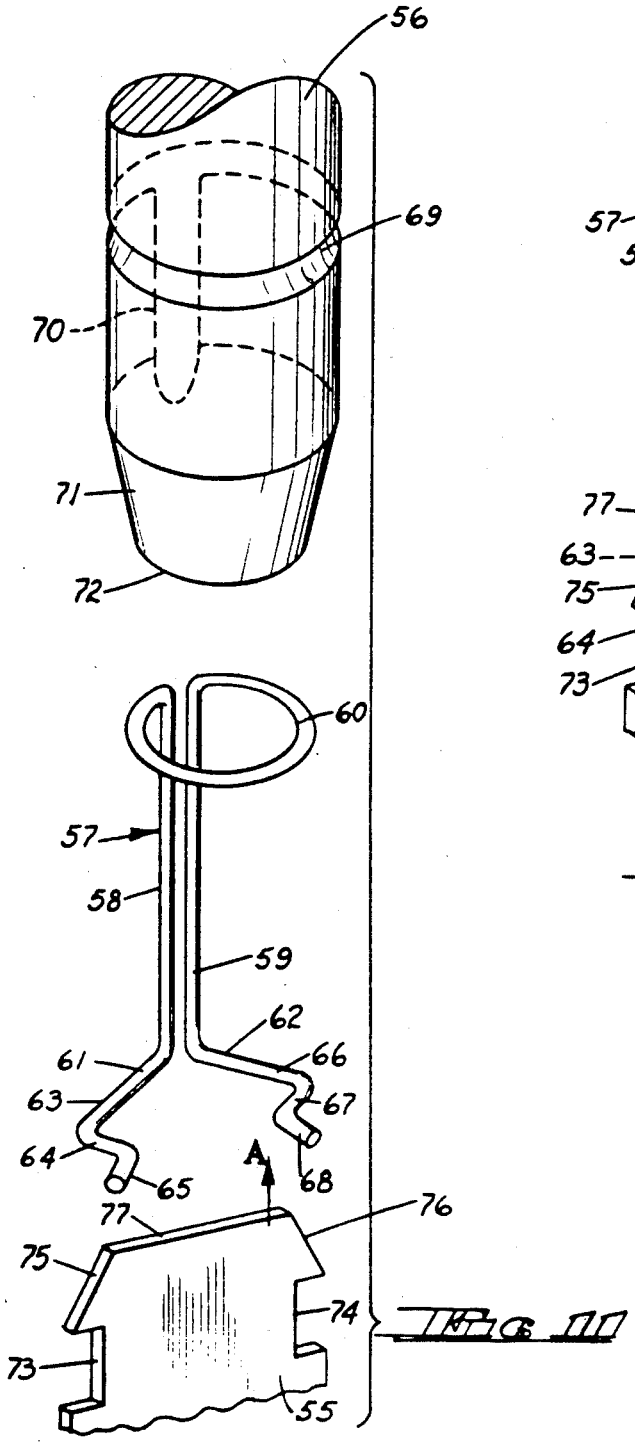

Reference is now made to FIGS. 8–10, wherein there is shown a latch-type embodiment of a resilient member to maintain the upper end of the cartridge driver adjacent the lower end of the tool driving element 2. In FIG. 8, the tool and magazine are again substantially identical to the tool 1 and magazine 5 of FIGS. 1, 2 and 5, and again like parts have been given like index numerals.

In the embodiment of FIG. 8, the magazine 5 is shown having a driver 43 provided with a bent-over upper end 43*a* lying at substantially 90° to the remainder of the driver 43. In this instance, the tool driving element 42 may be similar to tool driving element 2, differing only in that it is provided with a flat bottom surface 42*a*.

In the embodiment of FIG. 8, the means to associate the magazine driver 43 with the tool driving element 42 comprises a resilient latch member 44. The latch member 44 is best shown in FIGS. 9 and 10. The latch member 44 may be made of a tough resilient plastic material or may be stamped and formed from a resilient metal. Latch member 44 has a main elongated body portion 45 terminating at its lower end in a latch hook portion 46 having a latching upper surface 46*a*. At its upper end, the latch body 45 is provided with a perforation 47 by which it is pivotally attached to the tool body half 3*a*, as will be described hereinafter. The upper end of the latch body 45 may also be provided with a forwardly extending handle portion 48.

Along its forward edge, the body portion 45 terminates in an integral extension 49, which is bent at a 90° angle to the body portion 45. The extension 49 includes a downwardly depending resilient spring portion 50. The lowermost end of spring portion 50 is bent as at 51. As is most clearly shown in FIG. 8, the resilient latch member 44 is pivotally affixed to a boss 52 formed on the inside surface of body half 3*a*. The boss 52 is so sized that the hook portion 46 of latch member 44 is centered beneath the tool driving element 42. The latch member 44 is pivotally affixed to boss 52 by an appropriate fastener 53, passing through perforation 47 (see FIG. 10) of latch member 44. The fastener 53 may take any appropriate form, such as a rivet, a screw or the like. It will be noted from FIG. 8 that the latch member 44 is maintained in its normal latching position shown in FIG. 8 by the spring portion 50, the curve portion 51 of which abuts the inside surface of body half 3*a*. The handle portion 48 is optional. If provided, it may extend through a notch or slot 54 formed in body half 3*a* and body half 3*b* (not shown) so that the handle portion 48 can be manually engaged from the outside of tool 1.

The operation of latch member 44 is quite similar to the operation of resilient members 22 and 33, described above. When the magazine 5 is affixed to the tool 1 and the magazine driver 43 is in its initial retracted position shown in broken lines at FIG. 8, it is only necessary to press the tool 1 and magazine 5 against a workpiece once, to cause the magazine 5 to shift upwardly within the tool 1. As the magazine 5 moves upwardly within the tool 1, the bent-over upper portion 43*a* of driver 43 will contact the forward sloping edge of the hook portion 46 of latch member 44, causing the latch portion 46 to pivot clockwise (as viewed in FIG. 8) about fastener 53 and against the action of spring portion 50. As soon as the bent-over upper portion 43*a* of magazine driver 43 clears the hook portion 46, the hook portion 46 will return to its normal position shown in FIG. 8 with its upper surface 46*a* engaging the under surface of the upper bent-over portion 43*a* of magazine driver 43. When the tool and magazine are lifted from the workpiece, the latch member 44 will draw the magazine driver 43 out of the magazine to its extended position shown in FIG. 8, maintaining the upper bent-over portion 43*a* thereof just below and slightly spaced from the bottom end 42*a* of tool driving element 42.

It will be evident from FIG. 8 that the slight pivoting of magazine 5 about its forward laterally extending pins (one of which is shown at 9) during the magazine removal procedure, will cause the bent-over portion 43*a* of magazine driver 43 to slip out from between the hook portion upper edge 46*a* and the lower end 42*a* of tool driving element 42, enabling removal of magazine 5. In similar fashion, if magazine 5 is attached to tool 1 with its driver 43 in an extended position, the slight pivoting of magazine 5 about its forward lateral extending pins (one of which is shown at 9) in a counter-clockwise direction, as viewed in FIG. 8, will cause the bent-over portion 43*a* of magazine driver 43 to slip between the upper edge 46*a* of the latch member hook portion 46 and the lower end 42*a* of tool driving element 42, all of the parts assuming the position shown in FIG. 8 and ready for actuation of the tool. The association and disassociation of magazine driver 43 with tool driving element 42 will be the same as just described, in an instance where the magazine 5 is affixed to a carrier, rather than directly to the body of tool 1.

As indicated above, with respect to both a multiple-blow tool and a single-blow tool, the magazine driver may be releasably positioned adjacent the driving element of the fastening driving tool by a resilient member attached directly to the tool driving element. In fact, such a direct connection is mandatory when the fastener driving tool is of the single-blow type.

Figure 11:
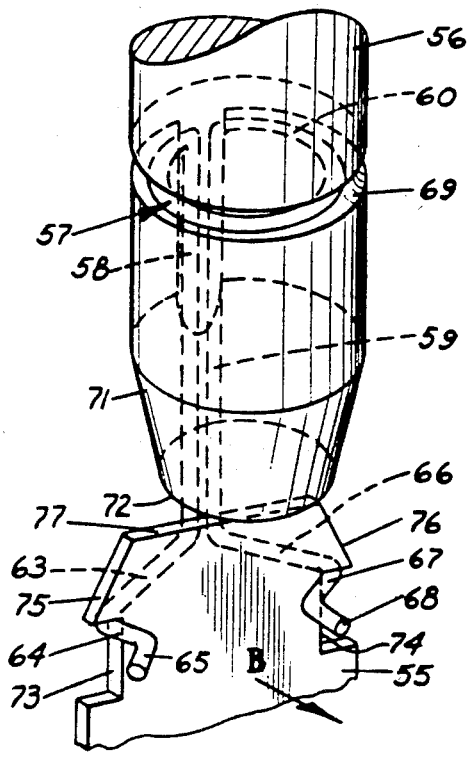
FIG. 11 is a fragmentary, exploded, perspective view of a magazine driver, a tool driving element and a resilient driver supporting element mountable directly on the tool driving element.

Reference is now made to FIGS. 11 and 12. In these Figures, a magazine driver is shown at 55. A tool driving element is shown at 56. The tool driving element may be the driving element of a multiple-blow tool or a single-blow tool. A resilient member to releasably position the driver 55 adjacent the tool driving element 56 is generally indicated at 57.

The element 57 is formed of a single piece of resilient wire and comprises a pair of elongated, vertical, rectilinear portions 58 and 59. The portions 58 and 59 terminate at their upper ends in a horizontal loop 60 of substantially circular configuration. At their lower ends, the vertical portions 58 and 59 terminate in the horizontal arms 61 and 62. The arm 61 comprises a first outwardly directed portion 63, terminating in a short inwardly directed portion 64 which, in turn, terminates in another outwardly directed portion 65. The arm 62 is a mirror image of arm 61 having an outwardly directed portion 66, an intermediate inwardly directed portion 67 and a final outwardly directed portion 68. The purpose of arms 61 and 62 will be apparent hereinafter.

The tool driving element 56 is provided with an annular groove 69. A vertical groove 70 is shown in broken lines extending downwardly from annular groove 69 and running out in the lowermost tapered portion 71 of the tool driving element 56.

The tapered end 71 of tool driving means 56 terminates in a flat surface 72. The tapered end portion 71 can be inserted in the circular looped portion 60 of resilient wire member 57 and shoved downwardly. This will tend to open the circular looped portion 60 of the wire-like element until the looped portion 60 reaches and snaps into the annular groove 69 of tool driving element 56. The vertical groove or slot 70 receives the vertical portions 58 and 59 of the resilient wire-like element 57. In this way, the resilient wire-like element 57 is fastened to the tool driving element 56 with a snap fit. Engagement of the vertical portions 58 and 59 of resilient wire-like element 57 in the vertical groove or slot 70 of the tool driving element will assure that the wire-like element 57 will not rotate about the axis of the tool driving element 56. The engagement of resilient wire-like member 57 on the tool driving element 56 is clearly shown in FIG. 12.

The magazine driver comprises a relatively thin, flat, elongated member having a pair of notches 73 and 74 formed therein. The remainder of magazine driver 55, immediately above notches 73 and 74, is of the same width as that portion of the driver below notches 73 and 74. However, this uppermost portion of the magazine driver 55 has side edges which slope upwardly and inwardly as at 75 and 76. These sloped edges 75 and 76 lead to the uppermost horizontal edge 77 of magazine driver 55. The uppermost horizontal edge 77 is of a length less than the width of that portion of the driver between notches 73 and 74.

The distance between the juncture of portions 63 and 64 of arm 61 and portions 66 and 67 of arm 62 approximates the width of that portion of the driver between notches 73 and 74. Thus, the uppermost horizontal edge 77 of driver 55 is of a length slightly less than this distance. The distance between the juncture of portions 64 and 65 of arm 61 and the portions 67 and 68 of the arm 62 is slightly less than the width of that portion of the driver located between notches 73 and 74.

When the tool driving element 56 constitutes the tool driving element of a multiple-blow tool so that the magazine, affixed either directly to the tool body or to a carrier, is shiftable between a normal extended position and a retracted position within the tool body, the magazine driver 55 may be associated with the tool driving element 56 by simply pressing the tool and its magazine against a workpiece. This will cause driver 55 to approach the resilient wire-like element 57 in the direction of arrow A in FIG. 11. The uppermost edge 77 of the driver 55 will enter between the arms 61 and 62 of the resilient wire-like member 57. The sloped side edges 75 and 76 will engage arms 61 and 62, respectively, at the juncture of arm portions 63 and 64 and the juncture of arm portions 66 and 67. Further upward movement of driver 55 will result in the sloped edges 75 and 76 thereof camming legs 61 and 62 apart until driver notches 73 and 74 are reached, at which time the arms 61 and 62 will snap into notches 73 and 74, engaging the edges of that portion of the driver 55 between notches 73 and 74. This is clearly shown in FIG. 12. When the arms 61 and 62 engage driver 55, they will maintain the driver upper edge 77 slightly spaced from the bottom surface 72 of tool driving element 56. It should be noted that the notches 73 and 74 in magazine driver 55 are of such length that when the uppermost edge 77 of magazine driver 55 abuts the lowermost surface 72 of tool driving element 56, the arms 61 and 62 of the resilient wire-like member will not bottom in notches 73 and 74.

It should be remembered that, when the magazine is removed from the tool, the rear end of the magazine is first released, resulting in slight pivoting of the magazine about its forward laterally extending pins. This will cause driver 55 to rotate slightly in the direction of arrow B of FIG. 12. That portion of driver 55 located between notches 73 and 74 will operate on resilient wire-like member leg portions 64 and 67 to spread the legs 61 and 62 apart sufficiently to enable the driver 55 to be disengaged therefrom.

If the magazine is replaced on the tool with its driver 55 in its up or extended position, it will be remembered that the forward laterally extending pins of the magazine are first engaged in the tool body or the carrier and then the magazine is rotated slightly thereabout to engage its rearward end with the tool body or carrier. This slight rotation of the magazine will cause the driver to shift toward the resilient wire-like member 57 in a direction opposite the direction of arrow B. In this instance, that portion of driver 55 located between notches 73 and 74 will initially engage resilient wire-like spring member leg portions 65 and 68. Further movement of the driver 55 in a direction opposite that of arrow B will cause the leg portions 65 and 68 to cam apart until the driver 55 achieves its fully seated position with respect to the resilient wire-like member 57, as shown in FIG. 12.

It should be remembered that if the tool driving element is a tool driving element of a single-blow tool, the magazine is attachable and detachable directly to the tool body or to a tool carrier. In either instance, the magazine and the tool carrier, if present, are fixedly mounted with respect to the tool body, the magazine not being shiftable between extended and retracted positions, as in the case of a multiple-blow tool. If driver 55 is in its down or retracted position, it is only necessary to fire the tool causing tool driving element 56 and its associated member 57 to approach the sloped edges 75 and 76 of driver 55, with edges 75 and 76 camming legs 61 and 62 of member 57 apart, as described above. If the driver 55 is in its extended position, attachment and detachment of the magazine from the tool and attachment and detachment of the magazine driver 55 from the resilient wire-like member 57 are the same as described above with respect to the driver when in its up position. Thus, the driver 55 will approach the resilient wire-like member 57 in a direction opposite the direction of arrow B in FIG. 12 during magazine attachment, camming leg portions 65 and 68 apart until engaged by the resilient wire-like member 57 with a snap fit. Upon removal of the magazine, the driver 55 will be rotated in the direction of arrow B and that portion of driver 55 between slots 73 and 74 will operate on leg portions 64 and 68, causing them to spread until the driver is released from the resilient wire-like member 57.

It should be understood that if the tool driving element 56 is other than of a circular cross-section, the looped portion 60 may be appropriately configured. For example, if the tool driving element is a thin flat member of rectangular cross-section, the loop configuration 60 of the wire-like resilient member 57 may also be formed into a narrow rectangle engaging a pair of edge notches in the tool driving element. Other means of attaching wire-like element 57 to the tool driving element may be employed, including welding or the like. The resilient wire-like element 57 could be made in more than one part.

Modifications may be made in the invention without departing from the spirit of.

What is claimed is:

1. In a fastener driving tool of the type comprising a body, a driving element said driving element having a free end within said body, a fastener-containing magazine manually attachable and detachable from said tool, the improvement comprising a fastener driver constituting a part of said magazine and having a free end outside said magazine and a driving end within said magazine, and means for associating said fastener driver with said driving element, said last mentioned means comprising at least one resilient member, said at least one resilient member having a first end affixed to one of said tool body and said tool driving element, said resilient element having a second end releasably engageable with said fastener driver and configured to maintain said free end of said fastener driver adjacent to and slightly spaced from said free end of said tool driving element.

2. The structure claimed in claim 1, wherein said tool is of the type for driving a fastener by multiple blows, said first end of said resilient member being affixed to said tool body.

3. The structure claimed in claim 1, wherein said tool is of the type for driving a fastener by multiple blows, said first end of said resilient member being affixed to said tool driving element.

4. The structure claimed in claim 1, wherein said tool is of the type for driving a fastener by a single blow, said first end of said resilient member being affixed to said tool driving element.

5. The structure claimed in claim 2, wherein said fastener driver has a detent formed thereon near said free end thereof, said resilient member comprising a wire-like member of L-shape, having a long leg and a short leg joined at substantially a right angle and being coplanar, said long leg terminating in a free end rigidly affixed to said tool body, said short leg having a free end terminating in a lateral extension lying at substantially 90° to said short leg in a plane perpendicular to said plane of said legs, said lateral extension being so positioned as to be releasably engageable by said fastener driver detent to maintain said free end of said fastener driver adjacent to and slightly spaced from said free end of said tool driving element.

6. The structure claimed in claim 2, wherein said fastener driver has a detent formed thereon near said free end thereof, said resilient member comprising a wire-like member of L-shape, having a long leg and a short leg joined at substantially a right angle and being coplanar, said long leg terminating in a free end rigidly affixed to said tool body, said short leg being so positioned as to be releasably engageable by said fastener detent to maintain said free end of said fastener driver adjacent to and slightly spaced from said free end of said tool driving element.

7. The structure claimed in claim 2, wherein said fastener driver has a detent formed thereon near said free end thereof, said resilient member comprising a latch member having an elongated body with a first end pivotally affixed to said tool body and a second end configured as a latch hook, said resilient member body having an integral resilient extension, the free end of which abuts said tool body, said resilient extension being so configured as to yieldingly maintain said latch hook in a normal position centered with respect to and spaced from said free end of said tool driving element, said latch hook normal position being such that said latch hook is releasably engageable by said fastener driver detent to maintain said free end of said fastener driver adjacent to and slightly spaced from said free end of said tool driving element.

8. The structure claimed in claim 3, wherein said fastener driver has a pair of opposed notches formed therein near said free end thereof, said resilient member comprises a pair of rectilinear wire-like members extending in a direction parallel to the long axis of said tool driving element, said wire-like members having first ends affixed to said tool driving element, said wire-like members having second ends terminating in coplanar, spaced, mirror image arms extending substantially perpendicular to said wire-like members and in substantially the same direction, said arms being configured to releasably engage said fastener driver at said notches therein to maintain said free end of said fastener driver adjacent to and slightly spaced from said free end of said tool driving element.

9. The structure claimed in claim 4, wherein said fastener driver has a pair of opposed notches formed therein near said free end thereof, said resilient member comprises a pair of rectilinear wire-like members extending in a direction parallel to the long axis of said tool driving element, said wire-like members having first ends affixed to said tool driving element, said wire-like members having second ends terminating in coplanar, spaced, mirror image arms extending substantially perpendicular to said wire-like members and in substantially the same direction, said arms being configured to releasably engage said fastener driver at said notches therein to maintain said free end of said fastener driver adjacent to and slightly spaced from said free end of said tool driving element.

10. The structure claimed in claim 5, wherein said long leg free end terminates in a lateral extension extending in a direction opposite said short leg lateral extension, said long leg lateral extension being received in a perforation in said tool body, said adjacent portion of said long leg free end being received in a groove in said tool body whereby to achieve said rigid attachment of said long leg free end to said tool body.

11. The structure claimed in claim 6, wherein said free end of said resilient member long leg terminates in a looped portion and a return portion, both lying in a plane perpendicular to said plane of said long and short legs, said looped portion being attached to said tool body by a fastener, said body having a pair of integral spaced bosses, said long leg abutting one boss and said return portion abutting the other of said bosses, said bosses being so spaced that said long leg and said return portion are maintained in slight compression toward each other.

12. The structure claimed in claim 8, wherein said wire-like members comprise portions of a single integral one-piece resilient wire-like structure, said first ends of said wire-like members being joined together by a loop-like portion extending substantially perpendicular to said wire-like members and parallel to said arms, said free end of said tool driving element being cylindrical and having an annular notch formed therein, said loop-like portion being engaged in said annular notch with a snap fit, said tool driving element having a rectilinear notch extending from said annular notch toward said tool driving element free end, portions of said rectilinear wire-like members adjacent said loop portion being located in said rectilinear notch to prevent rotation of said resilient member with respect to said tool driving element.

13. The structure claimed in claim 9, wherein said wire-like members comprise portions of a single integral one-piece resilient wire-like structure, said first ends of said wire-like members being joined together by a loop-like portion extending substantially perpendicular to said wire-like members and parallel to said arms, said free end of said tool driving element being cylindrical and having an annular notch formed therein, said loop-like portion being engaged in said annular notch with a snap fit, said tool driving element having a rectilinear notch extending from said annular notch toward said tool driving element free end, portions of said rectilinear wire-like members adjacent said loop portion being located in said rectilinear notch to prevent rotation of said resilient member with respect to said tool driving element.

* * * * *